US005291717A

United States Patent [19]

Turner

[11] Patent Number: 5,291,717

[45] Date of Patent: Mar. 8, 1994

[54] CONSTRUCTION MEMBER AND METHOD FOR FORMING CURVED WALL AND THE LIKE

[76] Inventor: Arthur R. Turner, 9 The Parapeb, Terranaro-N.S.W. 2486, Australia

[21] Appl. No.: 701,282

[22] Filed: May 16, 1991

[30] Foreign Application Priority Data

May 18, 1990 [AU] Australia ..... PK0184

[51] Int. Cl.[5] ..... E04G 21/00

[52] U.S. Cl. ..... 52/745.07; 52/86; 52/247; 52/631

[58] Field of Search ..... 52/85-87, 52/89, 295, 631, 417, 105, 241, 243, 247, 187, 245, 631, 633, 254, 255

[56] References Cited

U.S. PATENT DOCUMENTS

| | | | |
|---|---|---|---|
| 743,946 | 11/1903 | Spaulding | 52/87 |
| 1,714,174 | 5/1929 | Lichtenberg et al. | 52/58 |
| 1,931,889 | 10/1933 | Brainard et al. | 52/85 X |
| 1,988,739 | 1/1935 | Jones | 52/85 |
| 1,999,426 | 4/1935 | Thayer | 52/85 X |
| 2,011,796 | 8/1935 | Christensen | 52/85 |
| 2,064,704 | 12/1935 | Vass | 52/85 |
| 2,127,806 | 8/1938 | Burt | 52/85 |
| 2,220,898 | 11/1940 | Franklin | 52/631 X |
| 3,008,273 | 11/1961 | Widin | 52/85 |
| 3,159,251 | 12/1964 | Becker . | |
| 3,465,488 | 9/1969 | Miller | 52/255 X |
| 3,568,388 | 3/1971 | Flackbarth et al. | 52/241 X |
| 3,631,647 | 1/1972 | Merkin | 52/241 X |
| 4,805,364 | 2/1989 | Smolik | 52/241 |

*Primary Examiner*—Carl D. Friedman
*Assistant Examiner*—Lan M. Mai
*Attorney, Agent, or Firm*—Blakely, Sokoloff, Taylor & Zafman

[57] ABSTRACT

A method and resulting wood frame that can be used to construct a wall. To create a curved wall, lines are scribed onto the floor to define the wall radius. The wood frame is constructed by first arranging a plurality of studs in a spaced apart arrangement. The studs have first and second surfaces along the longitudinal axis, which terminate at first and second ends that have bottom and top surfaces respectively. A flexible flat member is then attached to the first end of the studs. The flexible member has a base portion which is nailed to the first surface of the studs and a plurality of spaced apart tabs. Some of the tabs are immediately adjacent the bottom of the studs, while other tabs are located between the spaced apart studs. The attached studs are then lifted into place and the flexible member is bent until the curved member follows the scribed outline. The frame is then nailed to the floor through the tabs that are located between the studs. A second flexible member is then attached to the first end of the studs by nailing the base portion of the second member to the second surface of the studs. The tabs of the second member are nailed to the floor, such that the studs are rigidly attached to the floor in an arrangement to form a portion of an arc. Flexible wallboard is then attached to the studs to create a curved wall.

5 Claims, 2 Drawing Sheets

CONSTRUCTION MEMBER AND METHOD FOR FORMING CURVED WALL AND THE LIKE

This INVENTION relates to curved structures in buildings. The construction on site of a curved structure such as an arch, or a curved section of wall, is normally very time consuming and expensive. As the radius of an arch, for instance, and also its depth and profile, may vary considerably from one to the next, it will be apparent that such a structure must usually be individually planned and carefully erected. The same is true of a curved wall structure, which may be required to have a regular or irregular curve in plan view.

The general object of the present invention is to provide means whereby the erection of such curved structures may be very greatly simplified.

Accordingly, the invention resides broadly, in one embodiment, in a support member for a curved structure including a flexible band or strip with a series of adjacent attachment tabs extending from a side thereof, perpendicular to the band or strip. Two such members may be provided, oppositely arranged, the tabs being fixed to opposite sides of a building frame, the bands or strips being similarly curved to define an arch and being arranged to hold an arched finishing strip of flexible material. The bands or strips may be replaced or supplemented by channels, those of the two members being oppositely directed to receive the side portions of the finishing strip the width of which is selected to suit the depth of the required arch construction. The divisions between the tabs, in this case, may be extended through part of each channel for greater flexibility without undue distortion. In another application a pair of support members, each of the type comprising a band and a series of perpendicular tabs extending from one edge, may be fixed, through the tabs, to a floor and, inverted, to a ceiling to receive between the two pairs the lower and upper ends of a series of studs, fixed through the pairs of bands, in the construction of a curved wall. In a modification, only one support member is curved and fixed to each of the floor and ceiling, the tabs being provided at their distal ends with lugs extending from the tabs in the same direction as the band, each of the studs being fixed, through the band and the lug, in the construction of the curved wall.

In providing curved corners, external or internal, between walls at right angles there are provided quadrant-shaped metal, plastic or other suitable extruded or roll-formed sections terminating, at their sides, in attachment flanges for fixing to the two wall structures.

Figure 1:
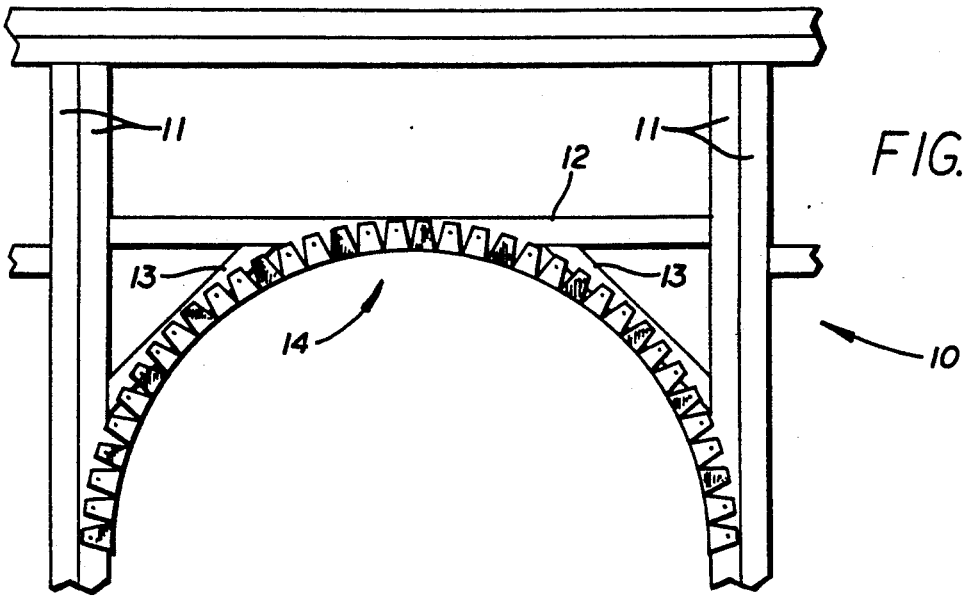
Figure 2:
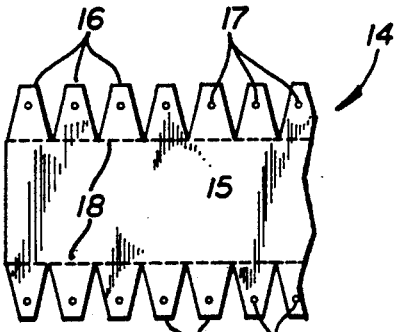
Figure 3:
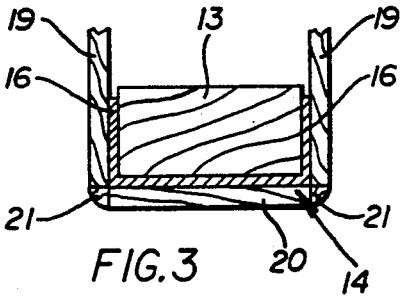
Figure 4:
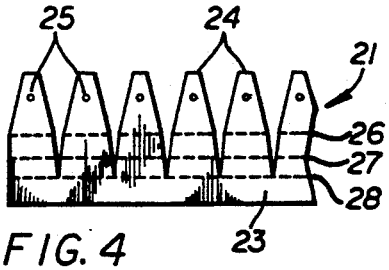
Figure 5:
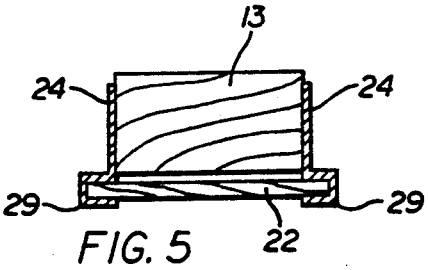
Figure 6:
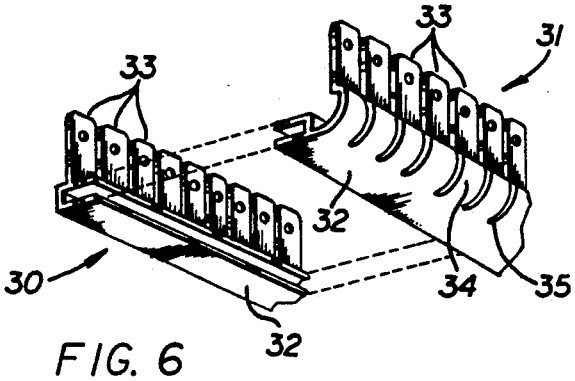
Figure 6A:
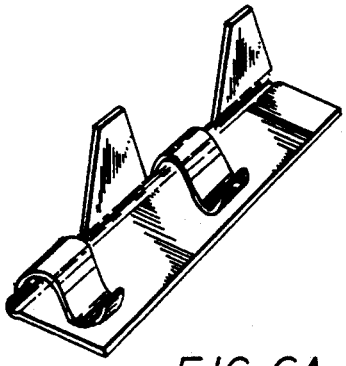
Figure 7:
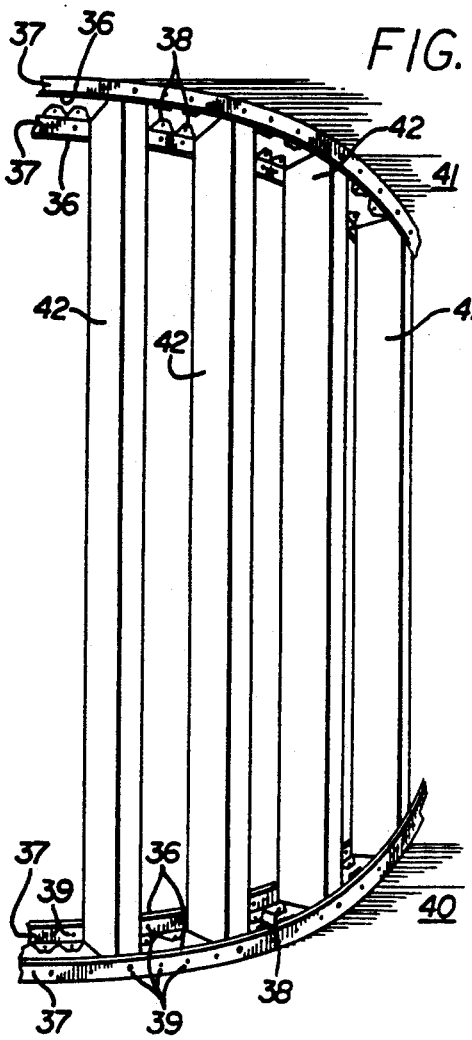
Figure 11:
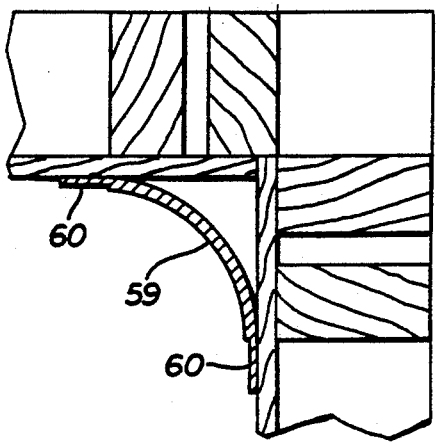
Figure 9:
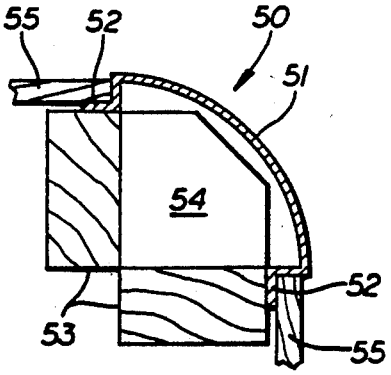
Figure 8:
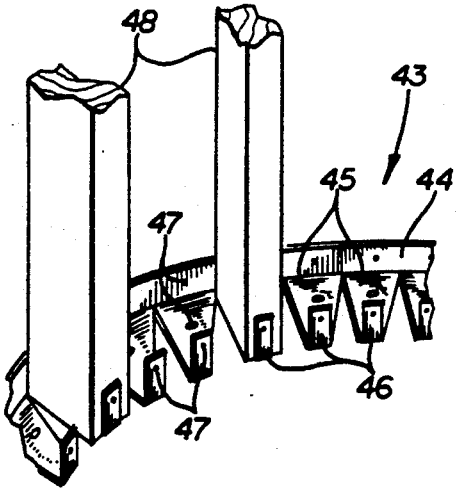
Figure 10:
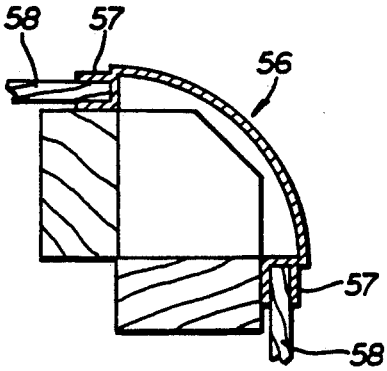

In order that various exemplary embodiments of the invention may be readily understood, reference is now made to the accompanying drawings, wherein:

FIG. 1 is a front elevational view of a support member according to the invention, curved and fixed to a timber support as a base for an archway, FIG. 2 is a plan view of part of a blank from which the support member is made, FIG. 3 is a cross-sectional view of part of a completed arch based upon the support member shown in FIGS. 1 and 2, FIG. 4 is a plan view of part of a blank from which an alternative form of support is to be made, FIG. 5 is a cross-sectional view of an arch structure based upon the support member of FIG. 4, FIGS. 6 and 6A are perspective views of further embodiments of arch support members, FIG. 7 is a perspective view of framing for a curved wall erected between support members according to a further embodiment of the invention, FIG. 8 shows in perspective view part of the framing for a curved wall based on a support member according to a still further form of the invention, FIG. 9 is a cross-sectional plan view of a curved exterior corner, FIG. 10 is a cross-sectional plan view of a curved exterior corner according to a modification, and FIG. 11 is a cross-sectional plan view of a curved interior corner.

Referring initially to FIGS. 1, 2 and 3 of the drawings, portion of a timber frame 10 of a building is erected in conventional manner to define an opening which is to be arched, the frame including studs 11 at the sides of the opening and a header 12 fixed between them, oblique braces 13 being fixed at angles of 45° between studs and header.

The support member 14 is made of any suitable flexible sheet material, such as galvanized sheet steel, which is also capable of being bent through right angles and retaining its bent shape. As shown in FIG. 2, it is produced by any appropriate metal working means as a blank comprising an elongated rectangular middle part 15 with a series of adjacent attachment tabs 16 extending from its side edges, each of the tabs being formed with a nail hole 17. At each side of the support member 14 the tabs are bent through right angles along the bend lines indicated at 18. This bending may be done in the course of producing lengths of the support member 14, or lengths of the blank may be produced flat, for ease of packing and transport, and the tabs 16 may be bent on site by any simple device for feeding the blank longitudinally and at the same time progressively bending the tabs through right angles.

As shown in FIG. 1, an appropriate length of the arch support member 14 is bent to the desired arch profile, the tabs 16 overlying members of the timber frame 10 and being fixed, where overlapping, by nails driven through nail holes 17. Wall board of any suitable type, as indicated at 19 in FIG. 3, is then fixed to both sides of the timber frame 10, having been pre-cut to the profile of the arch. In many cases it will be desired also to line the arch with a flexible lining strip 20, and to apply quadrant or plaster at 21.

In the modification shown in FIGS. 4 and 5, two oppositely arranged but otherwise similar support members 21 are provided instead of the single member 14 before described, and in conjunction with a plain central lining strip 22 of a flexible material such as wall board, cardboard, metal or plastic.

The support members are formed from a sheet metal blank as shown in FIG. 4 comprising an edge strip 23 from one side of which there extend a series of tabs 24 with nail holes 25. The tabs are bent through a right angle along bend line 26, and further right angle bends are made along parallel bend lines at 27 and 28 to produce a channel 29, which can be clipped onto a side edge of the central lining strip 22 so that the tabs 24 extend perpendicularly from this strip. It is to be noted that the divisions between the tabs 24 are extended to or near to the bend line 28 so that the channels 29 will not impart undue rigidity to the assembly, which can be bent to the desired arch shape and fixed to the timber frame 10 as before described. Wall board may be applied to the sides of the timber frame to overlie the tabs 24 and abut against the channels 29, any plaster or other finishing being added if required.

FIG. 6 shows in perspective two modified forms of support members 30 and 31, which may be of extruded plastic or metal, each support member being formed with a channel 32 and with attachment tabs 33. The support member 31 is formed, outwardly of its channel 32, with a quadrant curve portion 34 and the divisions between its tabs 33 are extended, at 35, around this curve to allow easy flexing of the support without other undesired distortion.

In the embodiment of FIG. 6A every second or third of the tabs are shaped to form clips for holding plaster, wallboard of the like, and may be dimpled or perforated for greated friction.

FIG. 7 shows the application of pairs of support members 36 to the erection of a curved wall structure. Each of the support members 36 comprises a flexible band 37 of metal or any other suitable material from one side of which there extend perpendicularly to the band a series of attachment tabs 38. Nail holes 39 are formed through all of the tabs 38, and also as a series along the band 37.

Similar curves of the desired shape are marked on the floor 40 and the ceiling 41 between which the wall is to be erected, and pairs of the support members 36 are nailed or otherwise secured to the floor and ceiling along the marked curved lines, the attachment tabs 38 of each pair being directed towards each other.

The pairs of support members 36 are so spaced that the top and bottom ends of studs 42 may be closely positioned between them, and secured by nails driven through the nail holes 39 of the bands 37. Flexible wall board (not shown) of any suitable type may then be curved and fixed to the studs on either or both sides, as may be required.

In the modification shown in FIG. 8, a single support member 43 is used, comprising an elongated band 44 of metal or other suitable material, having extending perpendicularly from its normally bottom edge a series of fairly elongated attachment tabs 45. Each tab tapers to its distal end, from which there extends upwardly a fixing lug 46. Nail holes 47 are formed through the band. The lugs 46 are so spaced from the band 44 that the ends of studs 48 will fit closely between them, as shown.

As before described, support members are fixed to the floor 49 and to the ceiling (not shown) along scribed curves, by nails through the holes in the attachment lugs 46. At required spacing, the studs 48 are positioned between the band 44 and lugs and are secured by nails driven through the nail holes in the band and in the lugs. If desired, a finishing band (not shown) of flexible material may be applied over the lugs 46.

In FIG. 9, an external curved corner is formed by the use of an extruded member 50 consisting of a quadrant-shaped piece 51 which at each end is stepped-down to an attachment flange 52. These flanges are nailed or otherwise secured to studs 53 fixed at right angles to each other between plates 54. Wall boarding sheets 55 are applied, with edges abutting against the steps of the quadrant piece 51, and the corner is finished off by plastering (not shown).

The embodiment shown in FIG. 10 differs from that of FIG. 9 only in that the ends of its quadrant-shaped piece 56 terminate in stepped-down channels 57 to receive edges of wall board 58.

In FIG. 11, an internal corner is provided by an extruded section having a quadrant-shaped main part 59 leading, at each end, to an attachment flange 60 of lesser thickness. The attachment flanges are nailed or otherwise fixed to the two perpendicular walls and finished with plastering or in any other desired manner.

Curved structures according to the invention will be found to be very effective in achieving the objects for which they have been devised. It will be understood, of course, that the embodiments herein described and illustrated by way of example only may be subject to many modifications or constructional detail and design, which will be readily apparent to skilled persons, without departing from the scope and ambit of the invention.

What is claimed is:

1. A method for constructing a curved wall on a floor, comprising the steps of:

a) marking a first arc on the floor;

b) providing a first flexible member which has a base portion and a plurality of tabs that extend from said base portion;

c) attaching one of said tabs of said first flexible member to the floor;

d) bending said first flexible member so that said base portion has a radius of curvature that corresponds with said first arc on the floor;

e) attaching said tabs of said first flexible member to the floor so that said base portion has a fixed radius of curvature;

f) marking a second arc on the floor;

g) providing a second flexible member which has a base portion and a plurality of tabs that extend from said base portion;

h) attaching one of said tabs of said second flexible member to the floor;

i) bending said second flexible member so that said base portion has a radius of curvature that corresponds with said second arc on the floor;

j) attaching said tabs of said second flexible member to the floor so that said base portion has a fixed radius of curvature;

k) inserting a plurality of studs between said first and second flexible members, said studs each having a pair of opposed longitudinal edges; and, l) attaching said base portions of said first and second flexible members to said longitudinal edge of said studs.

2. A curved wood frame structure, comprising:

a floor;

a plurality of studs having a first longitudinal edge, a second opposite longitudinal edge and a bottom end that is adjacent to said floor; and, a first flexible member having a base portion attached to said first longitudinal edges of said studs and a plurality of tabs extending from said base portion and attached to said floor, said base portion having a radius of curvature so that said studs are located along an arc on said floor.

3. The structure as recited in claim 2, further comprising a second flexible member that has a base portion attached to said second longitudinal edges of said studs and a plurality of tabs that extend from said base portion and are attached to said floor, said base portion having a radius of curvature.

4. The structure as recited in claim 3, further comprising a third flexible member and a fourth flexible member that each have a plurality of tabs attached to a ceiling, said third flexible member further having a base portion extending from said tabs and attached to said first longitudinal edges of said studs, said fourth flexible member further having a base portion extending from said tabs and attached to said second longitudinal edges of said studs.

5. The structure as recited in claim 2, wherein said second longitudinal edges of said studs are attached to lugs that extend from said tabs of said first flexible member.

* * * * *